US005529100A

United States Patent [19]

Koba

[11] Patent Number: 5,529,100

[45] Date of Patent: Jun. 25, 1996

[54] APPARATUS FOR DEHYDRATING SOFTWOOD VENEER

[75] Inventor: Yoshinori Koba, Obu, Japan

[73] Assignee: Meina Machinery Works, Inc., Obu, Japan

[21] Appl. No.: 358,267

[22] Filed: Dec. 19, 1994

[30] Foreign Application Priority Data

Dec. 27, 1993 [JP] Japan ..... 5-351616

[51] Int. Cl.[6] ..... B27M 1/02; B30B 9/20

[52] U.S. Cl. ..... 144/2.1; 144/362; 144/24.10; 100/121; 100/176; 492/30

[58] Field of Search ..... 144/2 R, 362; 100/98 R, 121, 176, 902; 492/28, 30, 32, 35

[56] References Cited

U.S. PATENT DOCUMENTS

| | | | |
|---|---|---|---|
| 4,691,629 | 9/1987 | Koba | 144/362 |
| 4,718,338 | 1/1988 | Koba . | |
| 4,790,360 | 12/1988 | Clarke et al. | 144/362 |
| 4,796,680 | 1/1989 | Koba | 144/362 |
| 4,850,404 | 7/1989 | Koba | 144/362 |
| 5,179,986 | 1/1993 | Beuving et al. | 144/362 |
| 5,234,040 | 8/1993 | Koba | 144/362 |

FOREIGN PATENT DOCUMENTS 52-9721 3/1977 Japan .

*Primary Examiner*—W. Donald Bray
*Attorney, Agent, or Firm*—Brooks Haidt Haffner & Delahunty

[57] ABSTRACT

A veneer dehydrating apparatus is disclosed which is intended to squeeze out part of water contained in green softwood veneer. The apparatus includes a pair of parallel rolls assemblies rotatable in opposite directions and disposed one above the other to be spaced apart from each other thereby to define an open nip between the circumferential peripheries thereof, and a conveyer for feeding successively sheets of green softwood veneer with the fiber orientation thereof directed along the feeding direction into said nip. One of the roll assemblies has formed on the peripheral surface thereof a number of individual projections pierceable into said veneer sheet at the nip. Each projection has a pyramidal shape with N faces, wherein N represents an integral number of four or more. The paired roll assemblies are spaced apart from each other to provide the open nip such that the shortest distance between the peripheral surfaces of said roll assemblies facing each other is larger than the radial height of said projections and corresponds to about 75 to 90 percent the thickness of the veneer sheet.

12 Claims, 11 Drawing Sheets

APPARATUS FOR DEHYDRATING SOFTWOOD VENEER

BACKGROUND OF THE INVENTION

The present invention relates to a veneer dehydrating apparatus having a pair of rotatable rolls through which a sheet of green, or not dried, wood veneer is passed to be compressed for squeezing part of water contained in the veneer sheet. More specifically, it relates to an apparatus which can be used advantageously for dehydrating coniferous or softwood veneer.

The purpose of veneer dehydration is to remove part of water contained in sheets of as-peeled green veneer, which is yet to be dried, for reducing its initial moisture content, thereby shortening the time required for the subsequent kiln drying of such sheets to the desired level of moisture content. A typical veneer dehydrating apparatus is disclosed by Publication of Examined Japanese Patent Application No. 52-9721 (1977). This apparatus includes a pair of rolls disposed one above the other, extending parallel to each other and spaced apart radially such that the veneer sheet is compressed by the rolls by about 30 to 60 percent of the sheet thickness as the sheet is being passed through the rolls. That is, the paired rolls are spaced apart from each other so as to provide a clearance between the peripheral surfaces thereof, whose distance in radial direction of the rolls corresponds to about 40 to 70 percent of the nominal thickness of veneer sheet to be processed. At least one of the rolls is formed on its periphery with a number of projections or ridges each extending in axial direction of the roll and having a height corresponding to about 50 percent or less of the veneer sheet thickness and a blunt or substantially flat tip face with a width of about 1 mm or less as measured across the axial extension of the ridge.

With this apparatus, a sheet of green veneer is fed toward the rolls with the general wood fiber orientation of the veneer directed perpendicularly to the sheet feeding direction and passed through the rolls. The veneer sheet is then compressed by the peripheral surfaces of the paired rolls by about 30 to 60 percent of its original thickness for squeezing part of water contained in the veneer sheet. In processing a veneer sheet of softwood with this apparatus, however, the veneer itself tends to be more readily deformed plastically or even broken when it is subjected to compression by about 30% or more of its original sheet thickness, with the result that the thickness of the dehydrated veneer sheet is reduced considerably. If a plurality of such plastically deformed veneer sheets laid up in a stack is hot-pressed for gluing in the manufacturing of plywood or LVL (laminated veneer lumber) panels, the resulting product may fall below a lower permissible limit of the desired product thickness, thus degrading its quality.

Another problem derives from the fact that a softwood veneer sheet contains many knots extending across its thickness and such knots tend to be broken readily into small pieces when the sheet is compressed by about 30 percent or more. Such wood pieces produced by broken knots may cause a trouble in the subsequent processes in handling of veneer sheets and making of plywood or LVL panels. As a matter of course, the resulting panel product having therein a void due to a broken knot will degrade its quality and limit the usage. Thus, the above conventional apparatus for dehydrating veneer by compression by rolls is not practically applicable to dehydrating softwood veneers.

If the dehydrating rolls of the apparatus are spaced so as to provide a larger space, for example about 75 percent or more of veneer sheet thickness, the above problems may be avoided, but satisfactory dehydration effect cannot be achieved because of insufficient compression of the sheet.

SUMMARY OF THE INVENTION

It is an object of the invention, therefore, to provide a veneer dehydrating apparatus which can dehydrate green softwood veneer sheet by compression without causing excessive plastic deformation or breakage to the sheet.

A veneer dehydrating apparatus of the invention is intended to squeeze out by compression part of water contained in green veneer of softwoods such as pines and firs. The apparatus includes a pair of cylindrical roll means rotatable about the axes thereof in opposite directions and disposed one above the other to extend axially parallel to each other and radially spaced thereby to define an open nip between the circumferential peripheries thereof, and means for feeding successively sheets of green softwood veneer with the general wood fiber orientation thereof directed along the sheet feeding direction. One of the roll means, which is preferably disposed above the other roll means, has formed on its peripheral surface a number of individual pyramidal projections pierceable into the veneer sheet in the region of the nip and extending radially outward from the peripheral surface.

The paired roll means of the apparatus according to the invention are spaced apart from each other to provide the above open nip specifically such that the shortest distance between the peripheral surfaces of the roll means facing each other is larger than the radial height of the projections and corresponds to about 75 to 90 percent the thickness of the veneer sheet. Thus, the veneer sheet passed through the nip between the two roll means is subjected to 10 to 25 percent compression across its thickness by the peripheral surfaces of the roll means and, simultaneously, to compression by the pyramidal projections acting in directions perpendicular to the sheet thickness. Veneer dehydration by the apparatus of the invention is accomplished by such compression.

The aforementioned one roll means includes a plurality of pairs of first and second roll sections axially combined together to provide a roll assembly having a total axial length that is greater than the width dimension of the veneer sheet as measured across the direction in which the sheet is conveyed by the feeding means. Each roll section has formed on the peripheral surfaces thereof with the projections extending along a series of circumferential rows equidistantly spaced at intervals of at least 2 mm axially of the roll section and, simultaneously, along a series of spiral rows equidistantly spaced at intervals of at least 5 mm in circumferential direction of the same roll section, and the spiral rows of the projection on two adjacent roll sections of each pair are directed to extend in substantially symmetrical opposite direction at a given angle, for example 55°, with respect to a plane passing radially through the roll section such that the spiral rows extend divergently toward the nip as seen from the veneer sheet feeding means. Such symmetrical arrangement of the projections on the paired roll sections helps to guide the water squeezed and coming out on the upper surface of the veneer sheet toward the center between the two roll sections.

In each quadrilateral pyramidal projection, one pair of opposite faces thereof makes an included angle of 30° to 90°, preferably 70°, while the other pair of opposite faces of the projection makes an including angle of 20° to 60°, preferably 42°, respectively. One pair of opposite edges of the quadrilateral pyramidal projection defined by any two adjacent faces thereof is longer than the other pair of opposite edges and the edges of the former pair are oriented at a smaller angle than the latter pair with respect to a circumferential line of said one roll means.

The veneer dehydrating apparatus of the invention further includes backup means disposed between each two adjacent pairs of roll sections for backing up the roll means against lifting or warping, thereby preventing the relative positional relationship between the paired roll means, hence the above-mentioned distance between the peripheral surfaces thereof, from being altered when a veneer sheet is passed through the nip.

The above and other objects, features and advantages of the invention will become apparent to those skilled in the art from the following description of a preferred embodiment of the veneer dehydrating apparatus according to the present invention, which description is made with reference to the accompanying drawings, wherein:

DETAILED DESCRIPTION OF PREFERRED EMBODIMENT

Figure 1:
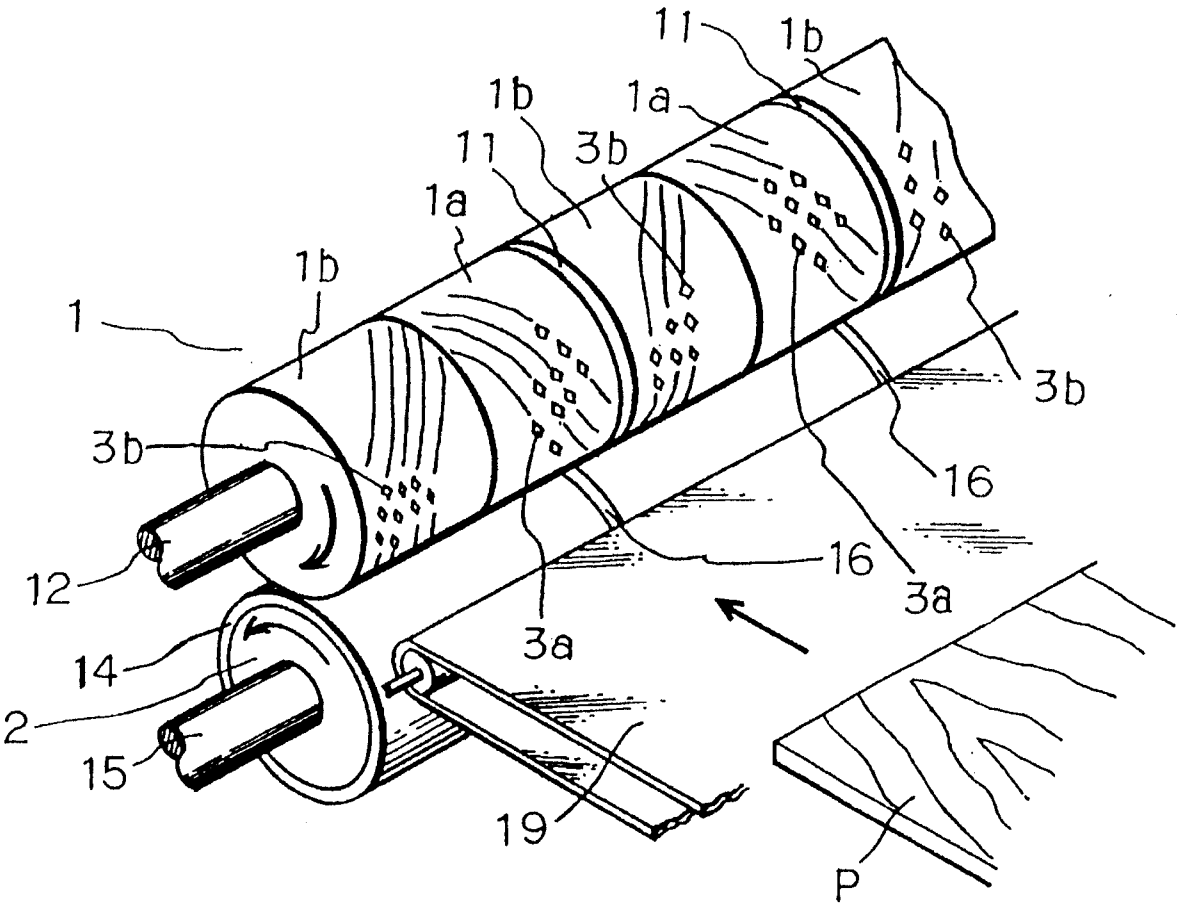
FIG. 1 is a perspective fragmentary view of a veneer dehydrating apparatus of the invention having an anvil roll assembly and a toothed roll assembly made of a plurality of roll sections.

Firstly referring to FIG. 1 showing schematically a veneer dehydrating apparatus of the invention, there is provided a pair of roll assemblies 1, 2 disposed one above the other in parallel to each other and supported on drive shafts 12, 15 for rotation therewith, respectively, and a conveyer 19 for moving a green softwood veneer sheet P with a nominal thickness of, for example, 3.5 mm toward the paired roll assemblies. The upper roll assembly 1 comprises a plurality of pairs of first and second roll sections 1*a*, 1*b* each made of rigid material such as steel and formed on the peripheral surface with a number of projections 3*a*, 3*b*. As seen in FIG. 1, these projections 3*a*, 3*b* are arranged on the respective roll sections 1*a*, 1*b* along a series of spiral rows which are symmetrically directed with respect to a plane extending through a joint between the roll sections 1*a*, 1*b* of each pair, exhibiting a somewhat herringbone pattern. Between any adjacent two pairs of the roll sections is provided an annular spacer 11 which will be described in detail in later part hereof. On the other hand, the lower roll assembly 2, which will be also described in detail later, provides an anvil roll.

The two roll assemblies 1, 2 are spaced apart from each other radially for a distance, the dimension of which will be given later, that provides a nip between the peripheries thereof, through which the veneer sheet P is forced to advance by rotation of the two roll assemblies while being subjected to compression by the roll assemblies and the projections 3*a*, 3*b* piercing into the veneer sheet.

Figure 2:
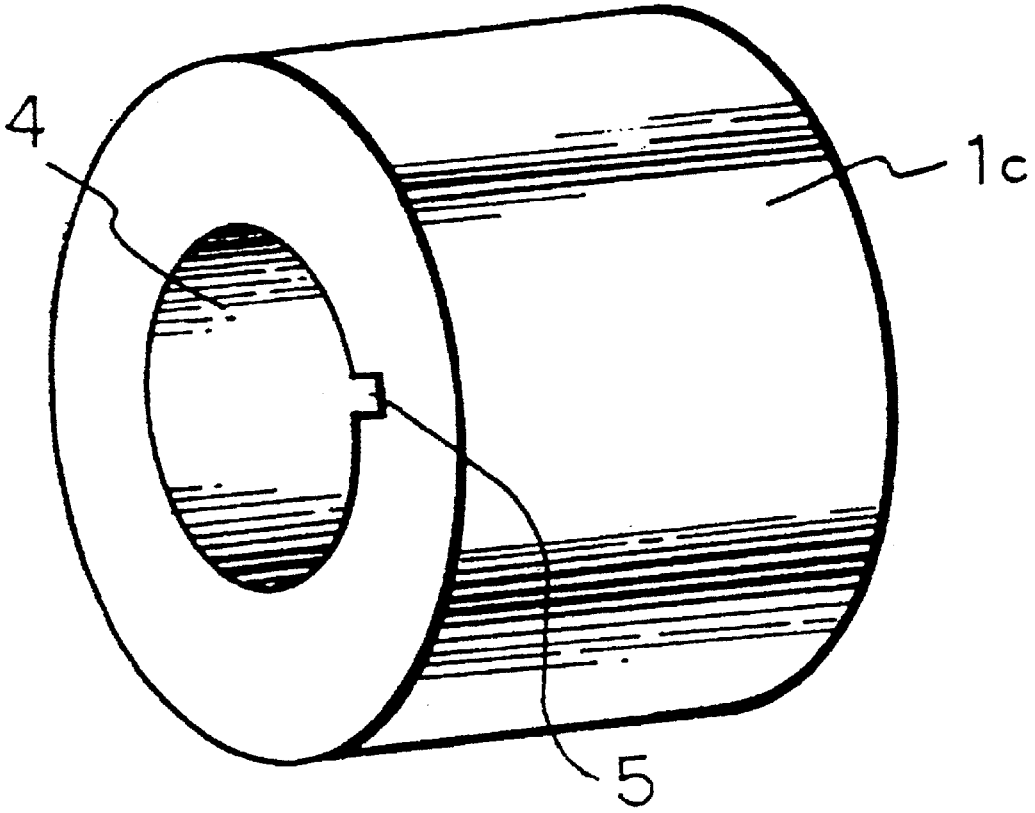
FIG. 2 is a perspective view of a cylindrical block used as a work which is reduced to one of the roll sections of the toothed roll assembly of FIG. 1.
Figure 3:
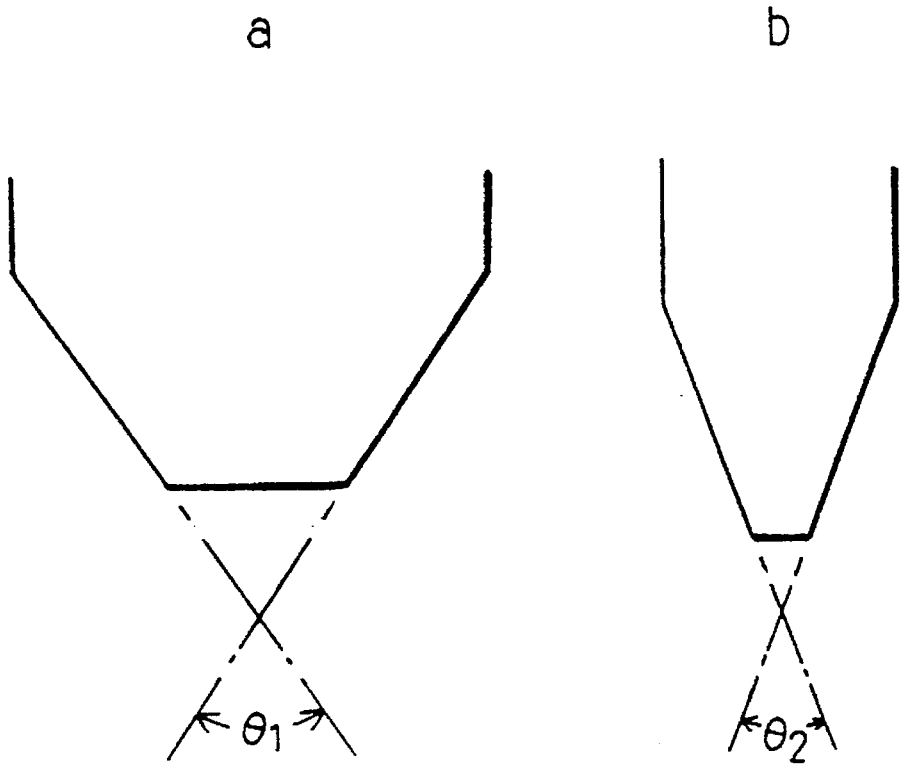
FIG. 3*a* is a schematic fragmentary view of one of the teeth of a milling cutter for cutting a spiral groove on the cylindrical block of FIG. 2.
FIG. 3*b* is a schematic fragmentary view of a cutting tool used on a lathe for cutting a circumferential groove on the block of FIG. 2.

Each roll section 1*a*, 1*b* can be made by cutting spiral and circumferential grooves on a cylindrical steel block 1*c* shown in FIG. 2 by using a milling machine and a turning lathe. For better understanding of the geometrical shape and arrangement of the projection 3*a*, 3*b*, a method of making the first and second roll sections 1*a*, 1*b* will be explained in detail in the following with reference to FIGS. 2 to 8.

Referring to FIG. 2, the cylindrical block 1*c* has a diameter of about 165 mm and an axial length of about 140 mm and it is formed with a central bore 4 having a diameter of about 75 mm for receiving therethrough the drive shaft 12. Reference numeral 5 designates an axial key slot 5 for receiving a key (not shown) on the drive shaft 12.

Figure 5:
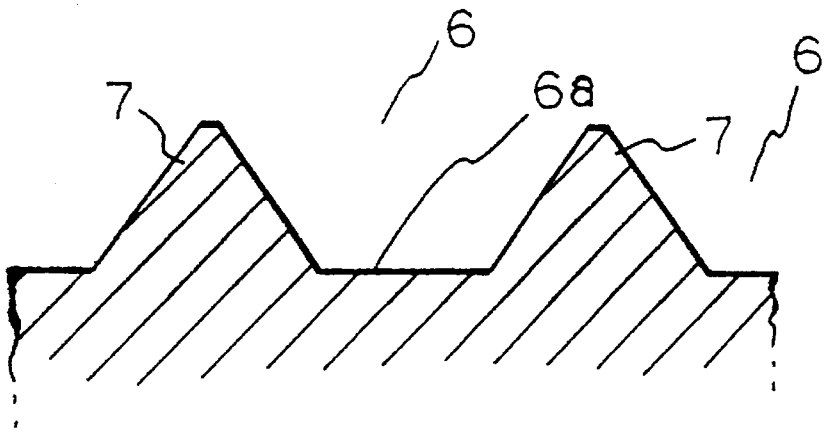
FIG. 5 is a sectional view as seen from line V—V of FIG. 4, showing two adjacent continuous spiral projections each formed between two adjacent spiral grooves.
Figure 4:
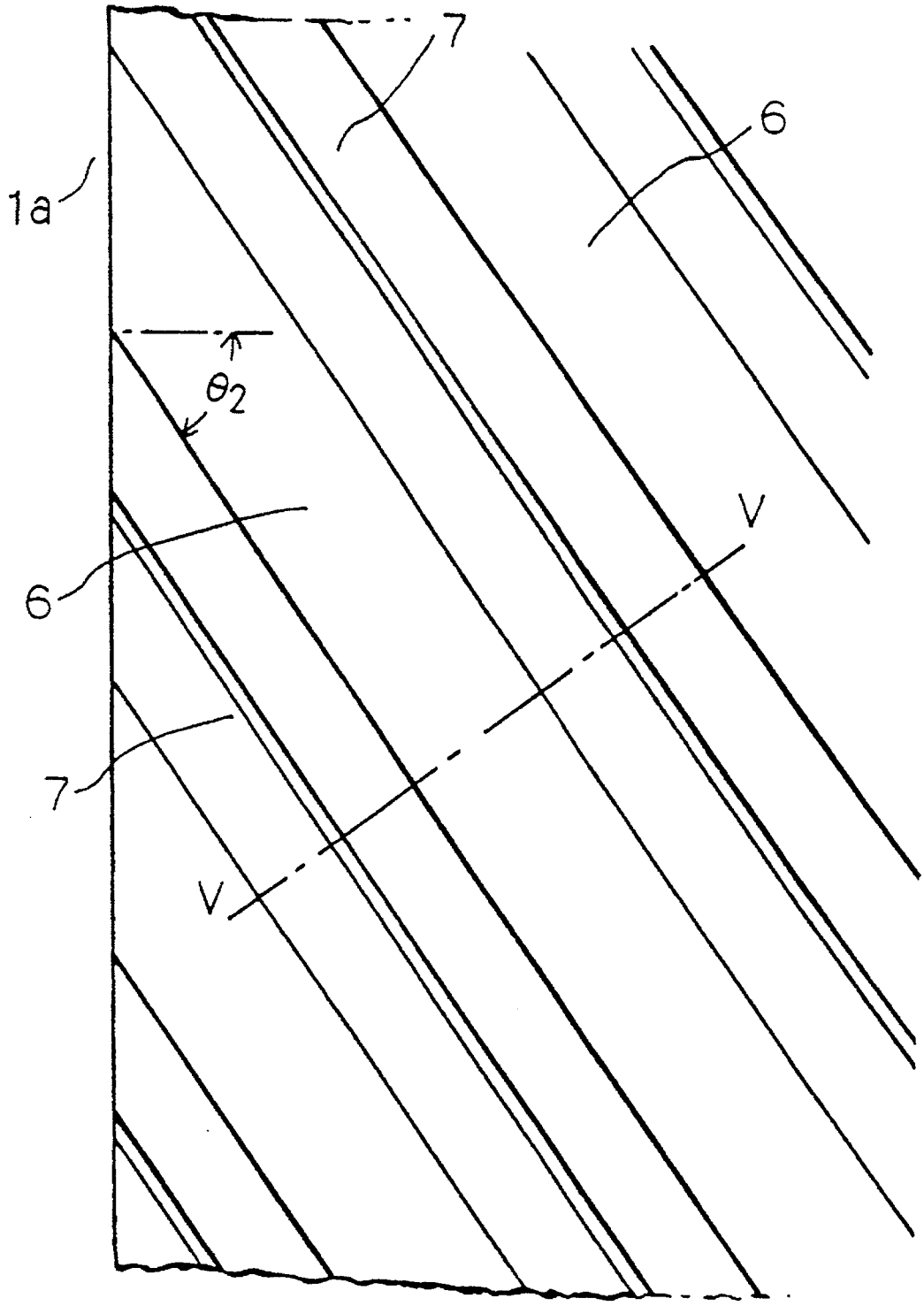
FIG. 4 is an enlarged illustrative fragmentary view of the periphery at one end portion of a first roll section in process, showing a method for forming a series of spiral grooves on the block of FIG. 2.

Firstly a method of making the first roll section 1*a* will be described. Using a grooving cutter with cutting teeth each having an included angle θ1 of about 70° and a tip face width of about 3 mm, as shown in FIG. 3*a*, a series of spiral grooves 6 with a depth of about 2.5 mm is cut from one end of the roll block 1*c* to the other at an inclination angle θ2 of about 55° with respect to a phantom line (dash-and-dot) drawn on the peripheral surface of the block 1*c* in parallel to the axial center thereof. The spiral grooves 6 are formed on the entire peripheral surface of the block 1*c* at angular intervals of about 8°, i.e. at circumferential intervals of about 11.5 mm, so that as many as 45 (=360/8) grooves 6, and hence spiral projections 7 in the form of continuous ridges of the same number, are formed as shown in FIG. 4. FIG. 5 provides a cross section as seen from line V—V of FIG. 4, showing two adjacent spiral projections 7 formed between two adjacent spiral grooves 6 and having opposite faces making therebetween an included angle of about 70°. Each groove 6 has a bottom face 6*a* with a width of about 3 mm.

As seen in the drawing, the tip of each spiral projection 7 remains uncut, thus exhibiting part of the original peripheral surface of the cylindrical block 1*c*.

Figure 6:
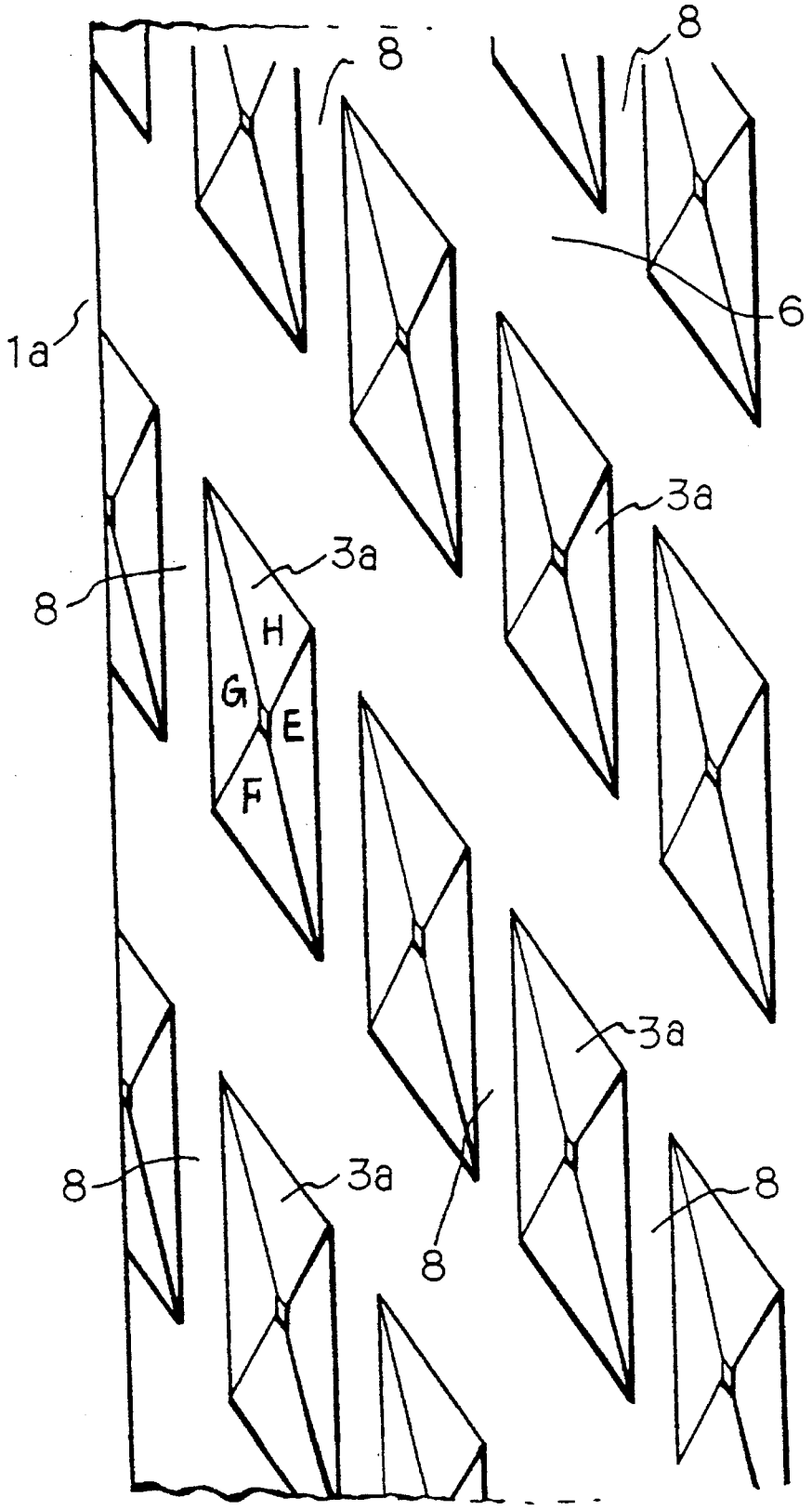
FIG. 6 is an enlarged illustrative fragmentary view of the periphery at the one end portion of the first roll section of FIG. 4, showing a method for forming a series of circumferential grooves on the block thereby to complete a number of individual pyramidal projections thereon.

Then, using a lathe with a cutting tool having an included angle θ3 of about 42° and a tip face width of about 1 mm, as shown in FIG. 3*b*, a series of circumferential grooves 8 is formed with the same depth as the grooves 6 at axial intervals of about 3 mm. This results in the formation of a number of individual quadrilateral pyramidal projections 3*a* with their tips truncated, as shown in FIG. 6, at circumferential and axial intervals of about 11.5 mm and 3 mm, respectively. Each projection 3*a* has a height of about 2.5 mm and four faces E, F, G and H, two opposite faces E, G and F, H of which make included angles of about 42° and 70°, respectively. Thus, the first toothed roll section 1*a* is completed.

Figure 7:
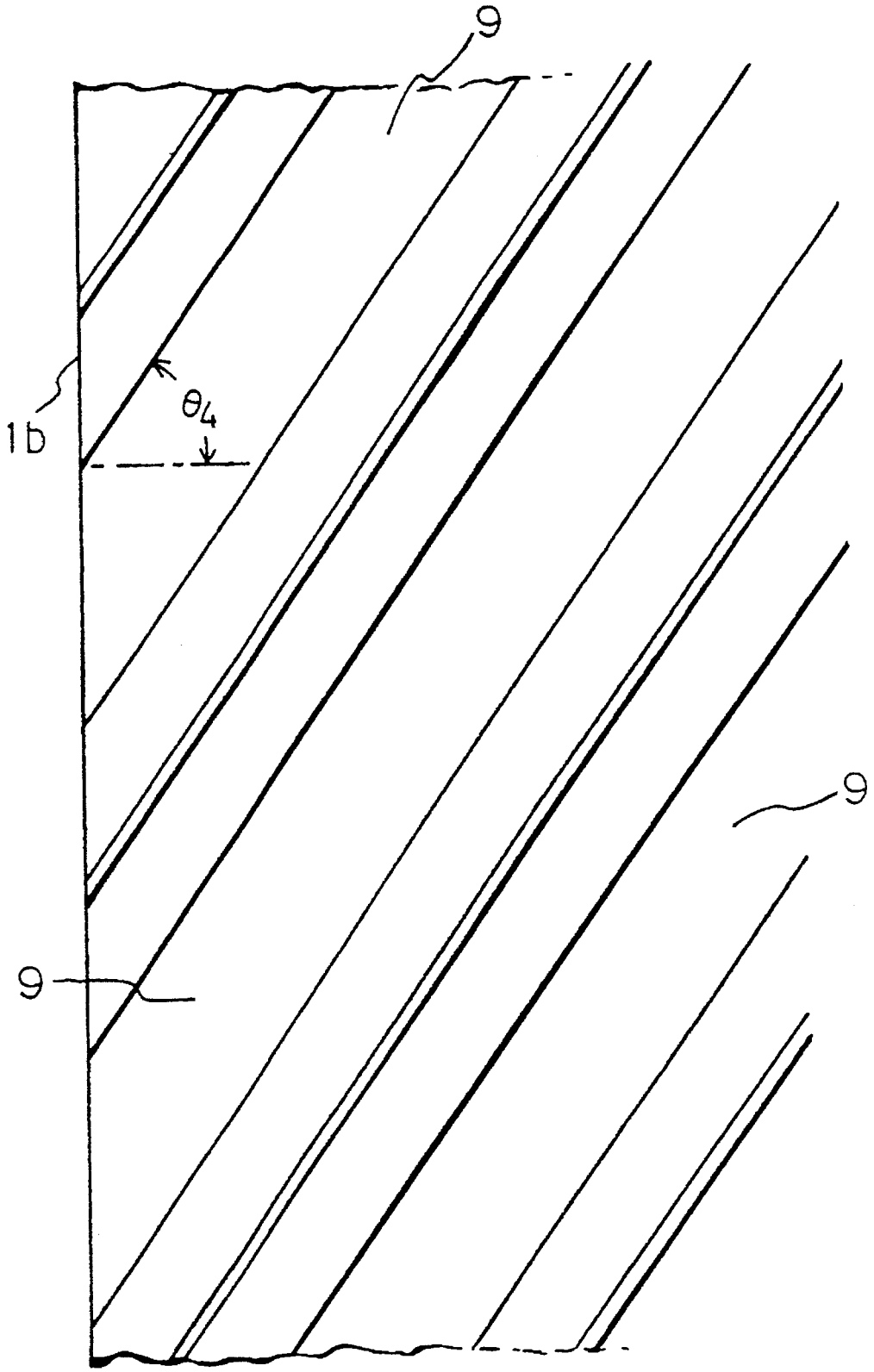
FIG. 7 is an enlarged illustrative fragmentary view similar to FIG. 4, but showing the circumferential periphery at one end portion of a second roll section of the toothed roll assembly of FIG. 1 formed with a series of spiral grooves on another block of FIG. 2.
Figure 8:
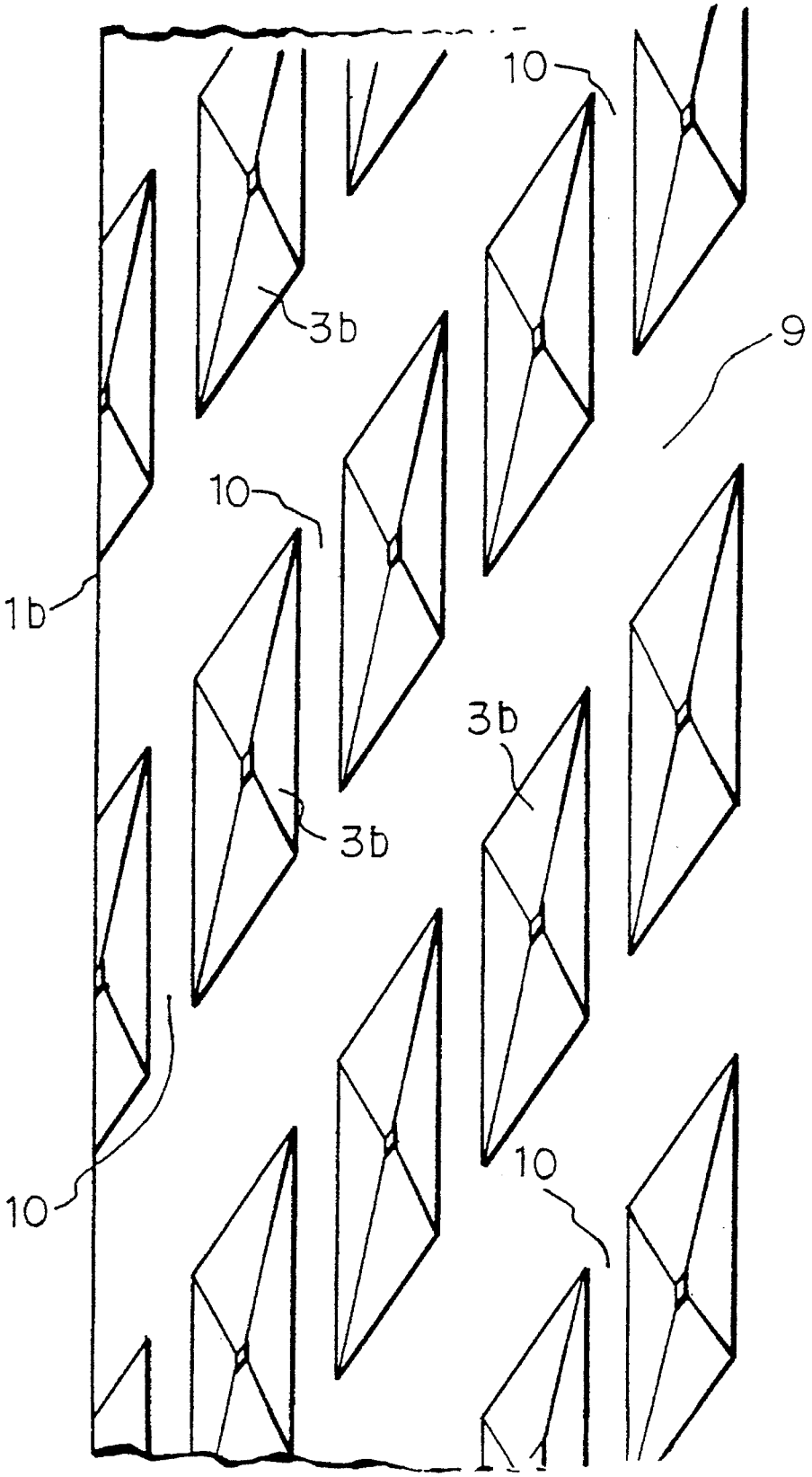
FIG. 8 is an enlarged illustrative fragmentary view similar to FIG. 6, but showing the periphery of the second roll section formed with a number of individual pyramidal projections thereon.

Now referring to FIGS. 7 and 8 illustrating the procedure of making projections 3*b* on the second toothed roll section 1*b* from another one of the cylindrical steel block 1*c* of FIG. 2, firstly, a series of spiral grooves 9 is formed by using the same grooving cutter of FIG. 3*a* on the periphery of the block 1*c* at the same inclination angle θ4 of about 55° with respect to the same dash-and-dot line, but extending in opposite spiral direction, with the other conditions including the grooving depth and the intervals remaining the same as in the grooving for the first roll section 1*a*. Then, using the same turning tool of FIG. 3*b*, a series of circumferential grooves 10 is formed with the same depth and at the same axial intervals as in making the first roll section 1*a*. This results in the provision of a second toothed roll section 1*b* having on its periphery a number of similar individual quadrilateral pyramidal projections 3*a*, as shown in FIG. 8. As seen from a comparison between FIG. 6 and 8, the pyramidal shape of the projections 3*a*, 3*b* and the arrangement thereof on the roll sections 1*a*, 1*b* are in a symmetrical relation to each other.

To make the roll assembly 1, a plurality of pairs of such first and second toothed roll sections 1*a*, 1*b* is to be provided and they are mounted on the drive shaft 12 so that the series of spiral rows of projections 3*a*, 3*b* on the roll sections exhibit a herringbone pattern as shown in FIG. 1. To be more specific, pairs of the roll sections 1*a*, 1*b* are installed axially on the drive shaft 12 along its key (not shown) and set in an end-to-end abutment such that the first roll section 1*a* of each pair is located to the right of its second roll counterpart 1*b* of the pair as viewed from the veneer conveyer 19, in order for the spiral rows of the projections 3*a*, 3*b* to extend divergently toward the nip of the two roll assemblies 1, 2 as seen from the veneer feeding side of the apparatus, the purpose of which will be explained in later part hereof. As mentioned earlier, a annular spacer 11 is mounted on the drive shaft 12 between each two adjacent pairs of the first and second roll sections 1*a*, 1*b*. Each spacer 11 has an outer diameter that is smaller than that of the cylindrical block 1*c*, say about 140 mm, the same inner diameter of about 75 mm as the block, and a thickness of about 8 mm. Though not shown in the drawing, the annular spacer 11 has a key slot engaged with the key on the drive shaft 12 when the former is mounted in place on the latter. To complete the toothed roll assembly 1, a desired number of pairs of the roll sections 1*a*, 1*b* and the spacers 11 are mounted successively on the shaft 12 such that the total axial length of such roll sections and spacers becomes slightly greater than the width dimension of the veneer sheets P. In a completed state of the roll assembly 1, the roll sections 1*a*, 1*b* and the spacers 11 are secured on the shaft 12 for rotation therewith in the arrow direction. Since the annular spacers 11 are smaller in outer diameter than the roll sections 1*a*, 1*b*, an annular groove having a depth of about 12.5 mm and a width of about 8 mm, which is defined by the spacer thickness, is formed between each two adjacent pairs of the roll sections. One end of the drive shaft 12 is operatively connected to a suitable drive motor rotating the shaft in the arrow direction.

The lower anvil roll assembly 2 includes a cylindrical steel core fixedly mounted on the drive shaft 15 for rotation therewith and having an outer diameter of about 153 mm and clad on the periphery thereof with a resilient material such as urethane rubber 14 with a Shore hardness of about Hs 120 and a thickness of about 6 mm. Thus, the anvil roll assembly 2 has substantially the same diameter as the cylindrical steel block 1*c* of FIG. 2 from which the first and second roll sections 1*a*, 1*b* of the toothed roll assembly 1 were made. It is noted that the urethane rubber layer is secured to the steel core by a known rubber-to-metal bonding to ensure tight cohesion between the two different materials. As seen in FIG. 1, the anvil roll assembly 2 has a plurality of annular grooves 16 with the same width and depth dimensions as the grooves at the spacers 11 in the upper roll assembly 1 at locations in correspondence with the spacers. The drive shaft 15 for the anvil roll assembly 2 is supported by any suitable bearing and operatively connected to a drive motor through gearing and chain to be driven in the arrow direction at the same speed as the drive shaft 12 so that the two roll assemblies 1, 2 rotate at the same peripheral speed.

Figure 9:
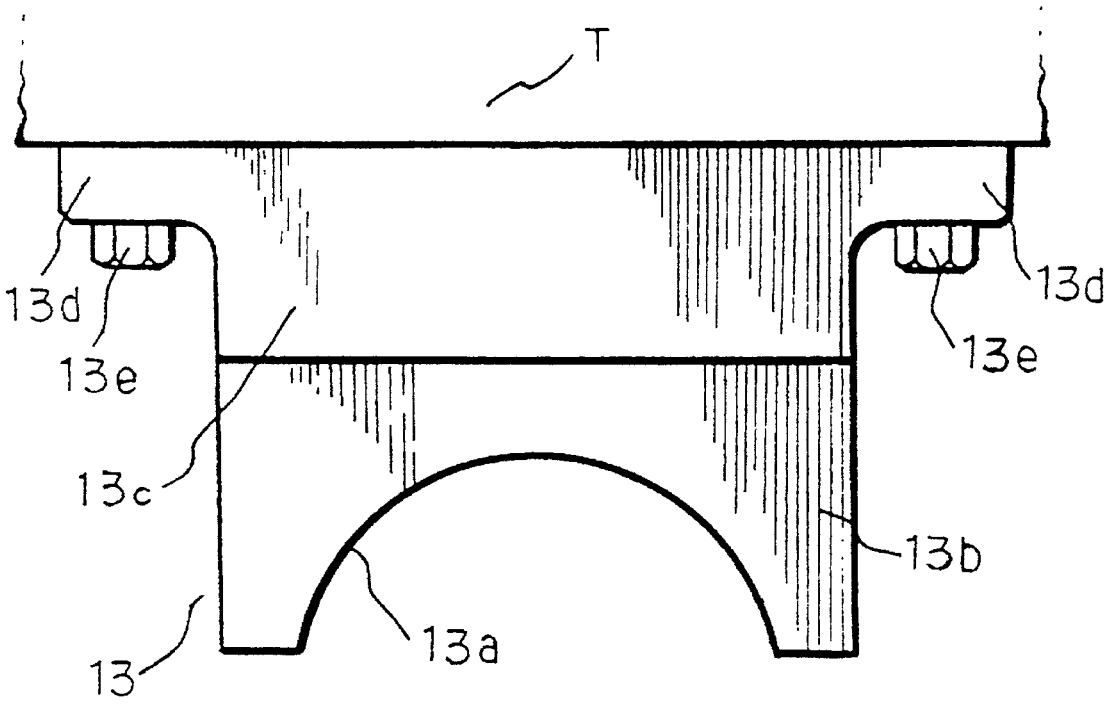
FIG. 9 is a side view of a backup device used to back up the roll assemblies of FIG. 1.

Now referring to FIG. 9, it shows a backup device 13 which is to be placed over an upper arc portion of each spacer 11 to prevent the roll assembly 1 from being lifted or warped by pressure exerted thereto when a veneer sheet is passed through the nip between the two roll assemblies. The device 13 includes a base portion 13*c* with a thickness of about 40 mm and a lower end portion 13*b* with a thickness that is smaller than that of the spacer 11, say about 7 mm. The lower end portion 13*b* is formed with a recessed face 13*a* having the same radius of curvature as the spacer 11 so as to be snugly fitted over the upper arc portion thereof. The base portion 13*c* is provided with flanged portions 13*d* through which bolts 13*e* can be inserted. In its operative position, the backup device 13 is set with its arc-shaped face 13*a* in contact with the spacer 11 and the flanged portions 13*d* secured to a suitable support member T by means of the bolts 13*e*. Though not shown in the drawings, the support member T carries radial bearings for supporting the opposite ends of the drive shaft 12 and it is so arranged that the roll assembly 1 and the support member T having the backup devices 13 depending therefrom can be moved together vertically as a unit for adjustment of the spacing between the two roll assemblies 1, 2 by means of any known device such as lead screw drive mechanism. For this reason, one end of the drive shaft 12 should be connected to the drive motor by way of any suitable universal joint to accommodate for the vertical displacement of the drive shaft 12. Though not shown in the drawing either, a backup device similar to that of FIG. 9 is provided for each of the grooves 16 so as to support or back up the lower anvil roll assembly 2. Apparently, the device is set with its recessed arc-shaped face 13*a* in contact with the bottom of each groove 16 to support the lower anvil roll assembly 2 from the bottom.

In processing sheets of the green veneer with the aforementioned nominal thickness of 3.5 mm, these two roll assemblies 1, 2 are radially spaced apart from each other so that the shortest distance between the peripheral surface of the upper roll assembly 1 which is defined by its innermost face 6*a* (FIG. 5) and the peripheral surface of the lower roll assembly 2 measures about 2.7 mm, i.e. about 77 percent of 3.5 mm of the veneer sheet thickness. This spacing adjustment can be accomplished by using the lead screw adjusting mechanism to raise or lower the upper roll assembly 1 together with the support member T and the backup devices 13. In this spaced position, the shortest distance between the peripheral surface of the anvil roll assembly 2 and the radially outermost tip end of the pyramidal projection 3*a* or 3*b* (2.5 mm high) located at its lowermost position in rotation of the roll assembly 1 is about 0.2 mm.

Figure 10:
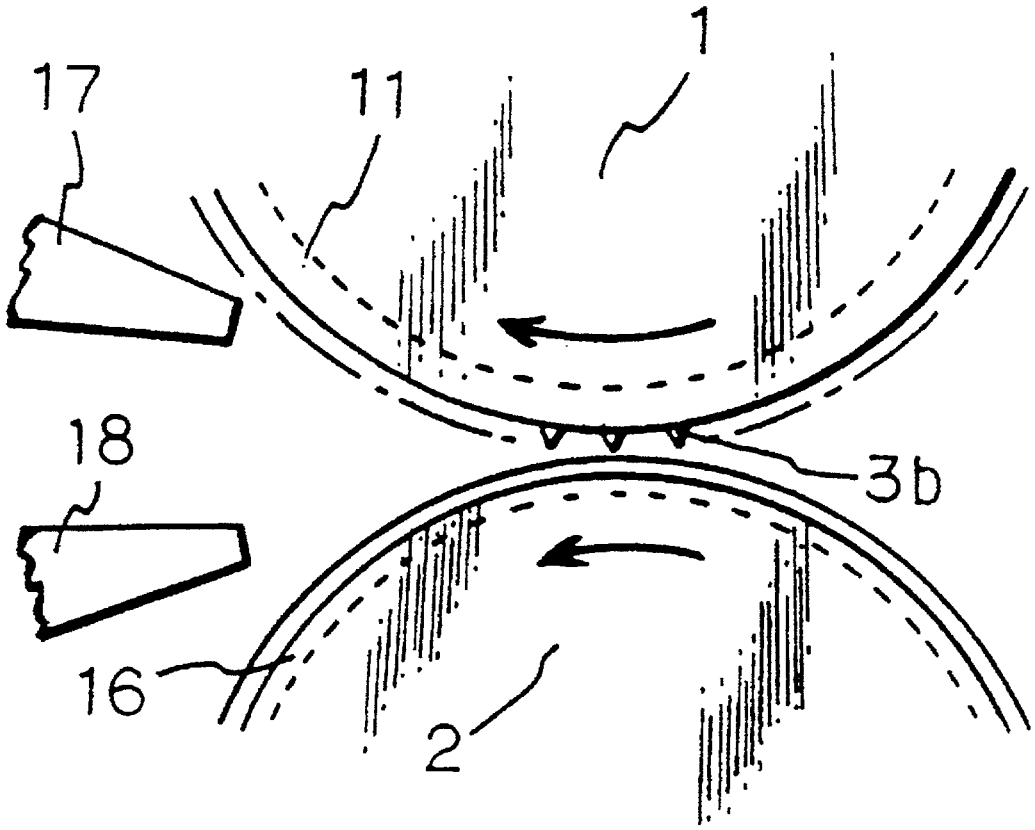
FIG. 10 is a schematic fragmentary cross-sectional view showing a pair of nozzles located on the delivery side of paired roll assemblies.

As shown in FIG. 10, a pair of nozzles 17, 18 is located adjacent the pair of roll assemblies 1, 2 on the delivery side thereof for directing compressed air against the regions of the spacers 11 of the upper toothed roll assembly 1 and the grooves 16 of the lower anvil roll assembly 2, respectively.

The following will explain the operation of the above-described apparatus in dehydrating a veneer sheet having the nominal thickness 3.5 mm.

A veneer sheet P placed on the conveyer 19 with its general fiber orientation directed along the conveying direction indicated by arrow in FIG. 1 is advanced into the nip between the two roll assemblies 1, 2 and passed through the nip by rotation of the roll assemblies which are spaced to provide a spacing of about 2.7 mm between the peripheral surfaces thereof. Accordingly, the veneer sheet P is compressed across its thickness by about 23 percent, i.e. reduced to about 77 percent of its original thickness, by the peripheral surface of the roll assemblies 1, 2 as the sheet is being passed therethrough. Simultaneously, the veneer sheet P is subjected to compression by the projections 3*a*, 3*b* on the toothed roll assembly 1 then piercing or incising into the sheet. Since the projections 3*a*, 3*b* are of a pyramid shape providing a wedging action, this compression takes place in directions transverse to the sheet thickness. Such compression by the roll peripheries and the projections 3*a*, 3*b* causes part of water contained in the veneer to be squeezed out thereof as the sheet is being moved between the roll assemblies. Though the roll assemblies 1, 2 are then subjected to reactional force of the veneer sheet P and the roll assemblies tend to be lifted or warped, such reactional force is received by the backup devices 13 shown in FIG. 9 and, therefore, the positional relationship of the two roll assemblies can remain unchanged without affecting the adjusted spacing.

Because the nip between the roll assemblies 1, 2 is completely closed or filled by the portion of the veneer sheet P that is just being compressed and also the squeezing pressure exerted on the veneer sheet across its thickness by the roll assemblies is the greatest where the peripheries of the two roll assemblies are located closest, most of the water squeezed out of the veneer sheet P flows toward the feeding side of the roll assemblies without flowing to the opposite delivery side and absorbed by the dehydrated veneer sheet coming past the nip and recovering its thickness in spite that the roll assemblies are rotating in the direction that causes the veneer sheet to move toward the delivery side. Therefore, most of the squeezed water is dropped by its own weight along the peripheral surface of the lower roll assembly 2 after the veneer sheet P has moved past the nip of the roll assemblies.

As the roll assembly 1 is rotated in the arrow direction shown in FIG. 1, the symmetrical spiral rows of projections 3*a*, 3*b* extending divergently toward the nip reduce the distance between any two symmetrical rows. Accordingly, most of the water squeezed and coming out on the upper surface of the veneer sheet P is guided and moved by the symmetrical spiral rows of projections toward the center between the roll sections 1*a*, 1*b* of each pair without flowing toward the recesses at the spacers 11 between any two adjacent pairs of roll sections. The water thus guided and collected in a region adjacent the above center between the paired roll sections 1*a*, 1*b* is dropped when the veneer sheet has moved past the nip, flowing down along the peripheral surface of the lower roll assembly 2.

Part of the squeezed water may flow into the spaces defined by the grooves 16 of the anvil roll assembly 2 and the recesses at the spacers 11, but compressed air issued form the air nozzles 17, 18 can force such water to flow toward the feeding side of the roll assemblies, thus preventing the dehydrated veneer sheet from attachment of squeezed water.

As described earlier, the green veneer sheet P is compressed across its thickness by about 23 percent thereof. Under this extent of compression, however, the veneer sheet is less susceptible to plastic deformation or breakage. During dehydrating operation of the apparatus, the veneer sheet P is subjected not only to such compression across the thickness, but also to piercing or wedging action by the projections 3*a*, 3*b* on the toothed roll assembly 1 to provide a water squeezing effect. The projections, for example 3*a* on the roll section 1*a*, can incise into the veneer in such a way as to separate the wood fibers apart across the grain direction by their relatively long edges of the pyramidal projection that are defined between adjacent faces E, F and G, H, respectively, and form a relatively small angle with respect to the general grain direction of the veneer. Simultaneously, the short edges of the projection defined between adjacent faces E, H and F, G, respectively, and directed at greater angles with respect to the general grain direction of the veneer sheet produce cuts in the veneer sheet surface in conjunction with the long edges and, simultaneously, and plastically deform the sheet by compression slightly across the sheet thickness and along the edge orienting direction. It is noted that, because of their pyramidal shape, the projections 3*a*, 3*b* can go into the wood veneer smoothly without pressing a large area on the veneer sheet. Thus, the veneer sheet passed through the paired roll assemblies of the apparatus is plastically deformed in the thickness direction only to such an extent that plywood or LVL panels resulting from such veneer sheets by hot-pressing can maintain a thickness that falls safely within the permissible limit of the desired product thickness.

The limited compression of a veneer sheet in its thickness direction in the apparatus of the invention makes a knot in a veneer sheet less susceptible to a breakage, only forming cuts in the knot by the projections. If a breakage should occur in a knot, it will not extend to the whole knot because the projections are formed at relatively large intervals of about 11.5 mm in the circumferential direction and about 3 mm in axial direction and hence the number of projections acting on a knot is limited. Thus, the quality of plywood or LVL panels produced from such veneer sheets will not be degraded by broken knots and the trouble causes by wood pieces resulting from a broken knot can be prevented. Regarding the above circumferential and axial intervals, they may be at least 5 mm and 2 mm, respectively.

It is noted that the projection is not necessarily required to be pointed at the tip as far as the projection can incise into wood veneer sheet, but it may have a blunt tip as in the above-described embodiment shown in FIGS. 5, 6 and 8. Additionally, the projection 3*a*, 3*b* is not necessarily required to be of a quadrilateral pyramid, but it may be of a multi-lateral pyramid having more than four faces, although the quadrilateral shape is more advantageous in terms of the ease of machining.

The upper and lower roller assemblies 1, 2 may be substituted with each other so that the rubber-clad roll assembly 2 is located above the toothed roll assembly 1 which then serves also as an anvil roll. In such a case, however, care should be taken to dispose the roll sections 1*a*, 1*b* of each pair in connection with the veneer sheet feeding direction so that the water squeezed and coming out from the lower surface of the sheet is guided toward the center of the roll sections while flowing down along the roll surfaces.

As is now apparent from the foregoing, in handling veneer sheets with thicknesses other than 3.5 mm in the above-described embodiment, the space setting of the two roll assemblies 1, 2 should be changed, if necessary, so that the distance between the peripheral surfaces thereof falls within the range of about 75 to 90 percent of the thickness of veneer sheets to be dehydrated. The geometrical shape of the pyramidal projections 3*a*, 3*b* on the roll assembly 1 is found suitable for dehydrating green veneer sheets with thicknesses from about 3 mm to 4 mm, although the shape may be modified depending on the thicknesses of veneer sheets to be processed.

Figure 11:
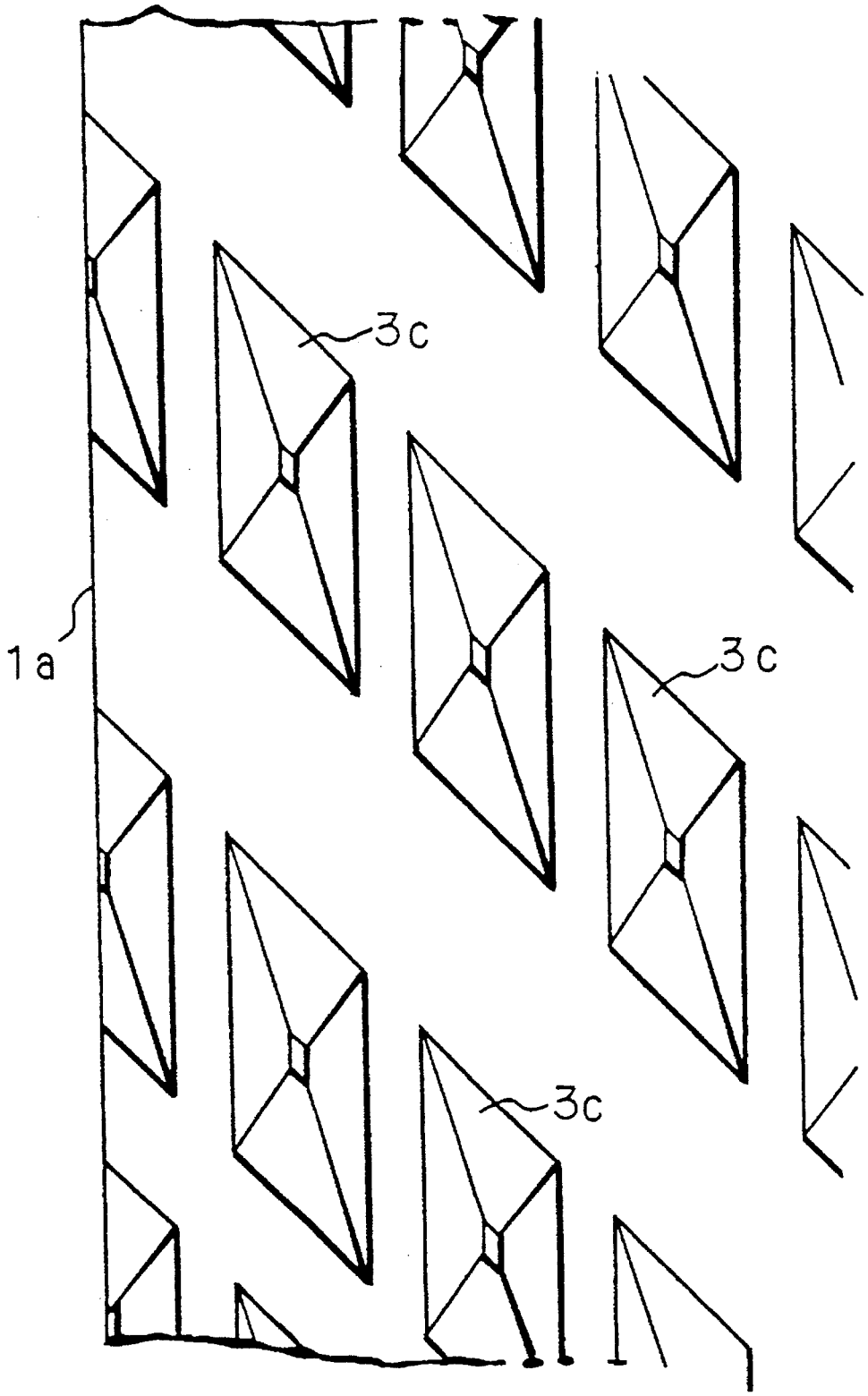
FIG. 11 is an enlarged illustrative fragmentary view similar to FIG. 6, but showing a modified arrangement of the projections on a roll section according to the invention.
Figure 12:
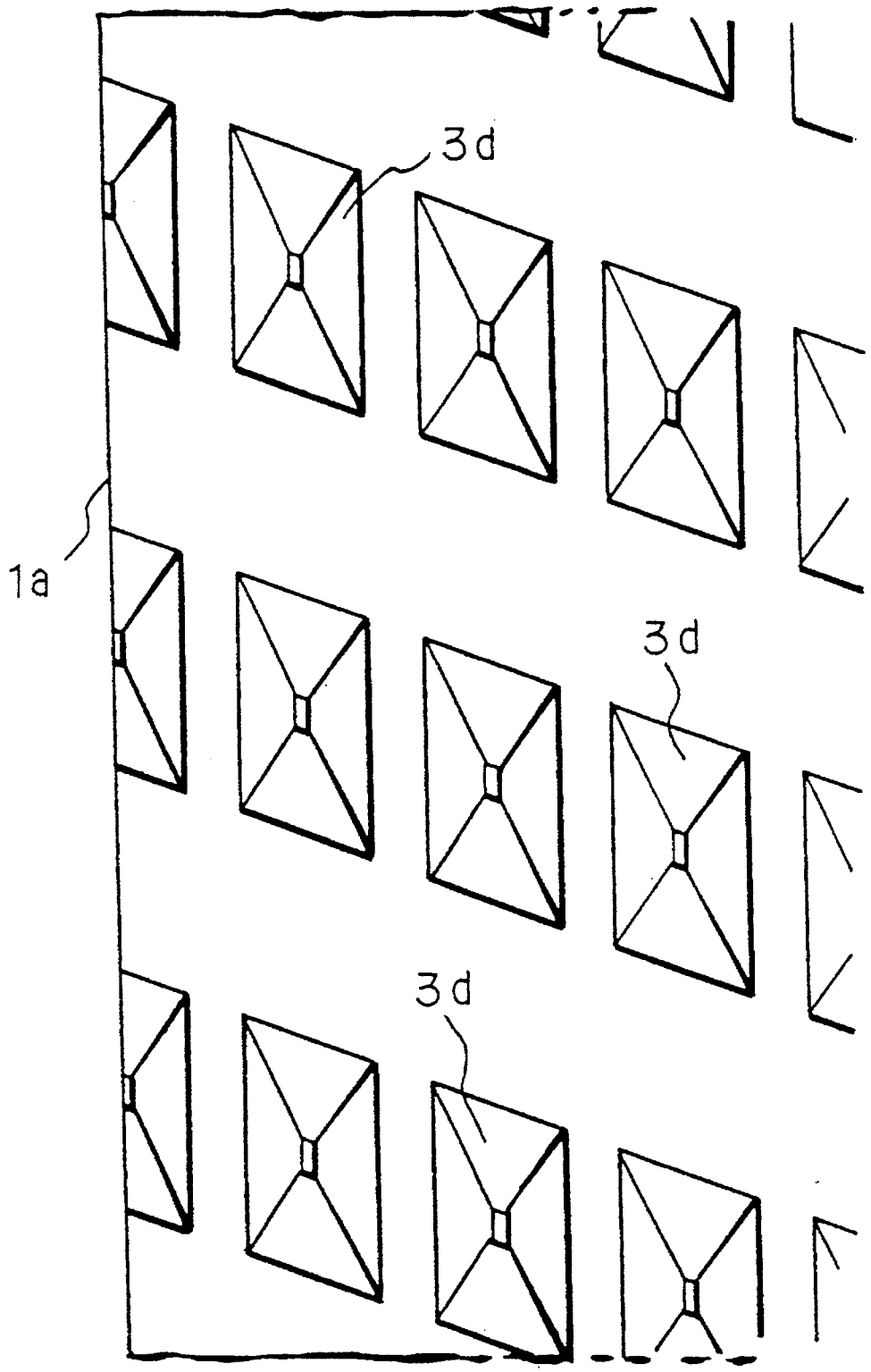
FIG. 12 is also a view similar to FIG. 6, but showing still another modified arrangement of the projections of the invention.

As shown in FIGS. 11, 12, the angles θ2 and θ4 of 55° for the spiral grooves 6, 9 (FIGS. 4, 7) may be changed to, for example, about 45° or 20° with other cutting conditions unchanged to provide the pyramidal projections 3*c*, 3*d* on the first and second toothed roll sections 1*a* (only the first roll section being shown). In this case, the included angles formed between the opposite faces E, G and F, H (indicated in FIG. 6) of the pyramidal shape of the resulting projections 3*c*, 3*d* are about 42° and 70°, respectively. With such projections, the edges between adjacent faces of the pyramid are generally oriented at larger angles with respect to the general fiber orientation of veneer sheet and, therefore, the pyramidal projection 3*c*, 3*d* tend to plastically deform the veneer sheet to a greater extent with less fiber-separating wedging action, thereby causing indentations on the surface of the sheet, as compared with the first embodiment using the projection 3*a*, 3*b* having longer edges between the adjacent faces of the pyramid. Although such indentations may cause poor adhesion of veneer sheets in the gluing process, such problem can be overcome easily by those skilled in the art by using an appropriate type adhesive suitable for the purpose.

Additionally, the included angles formed between the faces E, G and F, H of the pyramidal shape for the projections may be other than 42° and 70°. For example, the includes angles may be 30° to 90° and 20° to 60°, respectively, by using grooving tools with appropriate angles.

While the invention has been described and illustrated with reference to a specific embodiment, it is to be understood that the present invention can be practiced in other various changes and modifications without departing from the spirit or scope thereof.

What is claimed is:

1. A veneer dehydrating apparatus for squeezing out part of water contained in green softwood veneer comprising:

a pair of cylindrical roll means rotatable on the axes thereof in opposite directions and disposed one above the other to extend parallel to each other and be spaced apart from each other thereby to define an open nip between the circumferential peripheries thereof, means for feeding successively sheets of green softwood veneer with the fiber orientation thereof directed along the feeding direction into said nip, one of said roll means having formed on the peripheral surface thereof a number of individual projections pierceable into said veneer sheet at said nip, each of said projections extending radially outward from said peripheral surface and having a pyramidal shape with N faces, wherein N represents an integral number of four or more, said pair of roll means being spaced apart from each other to provide said open nip such that the shortest distance between the peripheral surfaces of said paired roll means facing each other is larger than the radial height of said projections and corresponds to about 75 to 90 percent the thickness of the veneer sheet.

2. A veneer dehydrating apparatus according to claim 1, wherein each of said projections has a quadrilateral pyramidal shape with four faces any two adjacent ones of which define an edge of the pyramidal shape.

3. A veneer dehydrating apparatus according to claim 2, wherein said one roll means includes a plurality of pairs of first and second roll sections axially combined together, said first and second roll section being arranged alternately to provide a total axial length which is greater than the width dimension of the veneer sheet as measured across the direction in which the sheet is conveyed by said feeding means, said quadrilateral pyramidal projections are disposed on the peripheral surface of each roll section, extending along a series of circumferential rows equidistantly spaced axially of said each roll section and, simultaneously, along a series of spiral rows equidistantly spaced in circumferential direction thereof.

4. A veneer dehydrating apparatus according to claim 3, said spiral rows of projections being directed at an angle with respect to a plane passing radially through said each roll section, said first and second rolls sections of each pair having said spiral rows of projections directed to extend in substantially symmetrically opposite directions with respect to a plane passing radially between said paired first and second roll sections such that said spiral rows extend divergently toward said nip as seen from said veneer sheet feeding means.

5. A veneer dehydrating apparatus according to claim 3, wherein said one roll means is disposed above the other roll means and said other roll means includes a peripheral surface made of a resilient material.

6. A veneer dehydrating apparatus according to claim 3, wherein said circumferential rows and said spiral rows are equidistantly spaced such that the centers thereof are spaced at intervals of at least 2 mm and 5 mm, respectively.

7. A veneer dehydrating apparatus according to claim 3, wherein one pair of opposite edges of said quadrilateral pyramidal projection is longer than the other pair of opposite edges thereof, the edges of said one pair being oriented at a smaller angle than the edges of said other pair with respect to a circumferential line of said one roll means.

8. A veneer dehydrating apparatus according to claim 6, wherein said circumferential rows and said spiral rows are equidistantly spaced such that the centers thereof are spaced at intervals of about 3 mm and about 11.5 mm, respectively.

9. A veneer dehydrating apparatus according to claim 3, wherein one pair of opposite faces of said quadrilateral pyramidal projection makes an included angle of 30° to 90° and the other pair of opposite faces of said projection makes an including angle of 20° to 60°, respectively.

10. A veneer dehydrating apparatus according to claim 7, wherein said one pair of opposite faces of said projection makes an included angle of about 70° and said other pair of opposite faces of said projection makes an included angle of about 42°.

11. A veneer dehydrating apparatus according to claim 2, wherein each of said projections has a truncated quadrilateral pyramidal shape.

12. A veneer dehydrating apparatus according to claim 3, further comprising backup means disposed between each two adjacent pairs of said roll sections for backing up said one roll means against warping when a veneer sheet is passed through said nip.

* * * * *